US005083775A

United States Patent [19]

Heard

[11] Patent Number: 5,083,775

[45] Date of Patent: Jan. 28, 1992

[54] PITCHING MACHINE

[75] Inventor: Martin P. Heard, Lubbock, Tex.

[73] Assignee: Kathryn Schmidt, Portland, Oreg. ; a part interest

[21] Appl. No.: 580,602

[22] Filed: Sep. 11, 1990

[51] Int. Cl.[5] ..... A63B 69/40

[52] U.S. Cl. ..... 273/26 E

[58] Field of Search ..... 273/26 E, 29 A, 26 R, 273/58 C, 414, 413

[56] References Cited

U.S. PATENT DOCUMENTS

| | | | |
|---|---|---|---|
| 2,058,277 | 10/1936 | Walther | 273/26 E |
| 3,333,847 | 8/1967 | Pennington | 273/26 E |
| 3,588,104 | 6/1971 | Griffin | 273/26 E |
| 3,637,208 | 1/1972 | Allred | 273/26 E |
| 3,885,790 | 5/1975 | Parr | 273/26 E |
| 4,815,735 | 3/1989 | McClenny | 273/26 E |
| 4,872,675 | 10/1989 | Crowden | 273/26 E |

*Primary Examiner*—Theatrice Brown
*Attorney, Agent, or Firm*—Wendell Coffee

[57] ABSTRACT

Apparatus and method for mechanically "pitching" a ball to a batter for the purpose of batting practice. A ball tethered to the end of a cord is revolved about a motorized base unit. The batter approaches the operating machine and positions him or herself so that they are positioned to bat the ball as it circles past them. The pitching machine has several elements for varying the "pitch" of the ball so that the batter is less likely to be able to anticipate the nest pitch thereby increasing his batting abilities. The ability of the entire machine to rock or wobble during operation, acts to produce a randomness in the pitches so that there is no pattern in the pitches delivered to the batter.

10 Claims, 2 Drawing Sheets

PITCHING MACHINE

RIGHTS TO INVENTIONS UNDER FEDERAL RESEARCH

There was no federally sponsored research and development concerning this invention.

BACKGROUND OF THE INVENTION (1) Field of the Invention

This invention relates to sporting equipment; more specifically to pitching machines used for batting practice. Those with ordinary skill in the art are coaches of baseball teams.

(2) Description of the Related Art

Batting practice is a necessary activity for both the professional and novice athlete who is involved in the sport of baseball or its several variations such as softball. Conventionally, for a batter to be able to practice another person is required to pitch balls to him or her.

In order to alleviate the necessity of a pitcher, machines have been invented that "throw" a ball to a batter simulating a pitched ball. One such invention is disclosed in U.S. Pat. No. to CROWDEN 4,872,675. CROWDEN shows a baseball pitching machine elevated above the ground on telescoping legs. The variable speed motor housed in the elevated structure is regulated by a remote control rheostat. A ball is fastened to a rope which is threaded through a hollow pole that is slidingly connected to a rotatable shaft above the mechanical housing. The shaft rotates the pole so that the ball revolves in a circular path about the elevated machine.

The end of the rope opposite the end to which the ball is fixed is fastened to a clamp which is slidingly connected to the pole. The length by which the rope extends from the pole is regulated by the position of the clamp. By moving the clamp toward the point of connection between the pole and the shaft, the extended length of the rope is shortened and the radius of the circular path of the ball is decreased.

Canadian Patent to DIELSCHNEIDER No. 712,035 discloses a ball circulating device that may be powered either manually or by a variable speed motor. Like CROWDEN, DIELSCHNEIDER shows the mechanical components of the device elevated above the ground. A vertical shaft projects upward from a rotating mechanism and bends at a 90 degree angle from which a pole extends outwardly away from the vertical shaft. A chain to which a ball is connected is fastened to the distal end of the pole.

In neither CROWDEN nor DIELSCHNEIDER is there a means for inclining the pole at an angle to horizontal.

U.S. Pat. No. to PENNINGTON 3,897,057 shows a manually operated rotatable baseball practice device that has an upwardly projecting shaft to which a 90 degree elbow is attached thereby connecting an extension pole to the shaft. Like the devices disclosed above, a flexible cord is fixed at the distal end of the extension pole with a ball attached to the other end of the cord. Unlike CROWDEN and DIELSCHNEIDER, the extension pole used in PENNINGTON '057 is not fixed horizontally but is instead adjustable so that it can be set at various angles of incline to horizontal.

U.S. Pat. No. 3,333,847, also issued to PENNINGTON for a batting practice device, has a foot responsive clutch drive. PENNINGTON 3 847, however, does not have means for inclining the extension pole from a horizontal position.

U.S. Pat. No. to GRIFFIN 3,588,104 discloses a baseball batting training device similar to those described above but includes a weighting system on an extension boom that can be operated to alter the flight path of the ball as said ball is revolved about the device.

Before this application was filed, the applicant was aware of the additional United States patents:

| | |
|---|---|
| 3,408,070 | GONZALES |
| 3,637,208 | ALLRED |
| 3,885,790 | PARR. |

SUMMARY OF THE INVENTION (1) Progressive Contribution to the Art

This invention is a pitching machine which operates on a principal similar to those devices disclosed above in that a ball is revolved about a rotating mechanism. The ball is attached to a flexible cord which extends from a tubular pole that is rotated by an electric motor. While similar in some respects to the above described devices, this invention has several improvements and additional benefits over the known prior art.

One benefit is that the driving components of this invention are protected within a metal housing. The housing shields the working parts of the device from physical damage resulting from rough treatment during batting practice as well as shielding it from environmental elements such as rain and dirt. Tubular sleeves located under the motor and housing lend protection against rising water in the event that water were to rise a couple of inches during a period when the device is left outdoors by elevating the machine slightly.

Another benefit that this device possesses over the known prior art is that the base unit which includes the motor and the housing by which the motor and a belt drive assembly is covered is low to the ground; the base unit is not elevated on legs above the ground. Additionally, the base unit includes a majority of the weight of the device. By keeping most of the machine's weight low to the ground, the center of gravity of the device is correspondingly low to the ground.

The low center of gravity lends stability to the pitching machine when in operation. The low center of gravity also enhances the device's ability to absorb the shock of a batted ball and minimizes the effect that a batted ball has on future passes of the ball by the batter.

Further stability is derived from anchor bolts which project through portions of a stabilizing assembly and stab into the ground directly below. These bolts serve to anchor the machine to the ground and add additional stability by preventing the machine from tipping during operation. The bolts also assure that the stabilizing arm remains within the stabilizing arm tube during operation of the pitching machine.

Another benefit is found in the structure by which the extension pole is connected to the rotating electric motor. A platform assembly connects the pole to the motor and has the ability to both fix one end of the extension pole to the platform assembly while inclining the pole away from its fixed end thereby elevating the distal end of the pole. The ability of the platform assembly to incline the pole at various angles to horizontal makes it possible to set the general height of the revolving ball at different levels for different batters.

The ability to set the general height of revolution of the ball, together with the motor's capability for variable speeds makes this invention suitable for all ages as well as batters having varying batting abilities. The pitching machine can be configured for different batters as well as for the same player as that player gets older and more proficient at batting.

The forces created by the revolving ball rocks or wobbles the pitching machine about a lengthwise center axis of the housing since the weight of the ball is not balanced as it circles about the base unit. The rocking is controlled by a stabilizing arm connected to the underneath of the base unit.

Because the pole and flexible cord which extends therefrom are fastened to the base unit, the rocking action of the base unit is transmitted to these components and to the ball which is tethered to the distal end of cord. The rocking of the base unit together with the rotation of the motor combine to produce a random flight path in the ball.

From the batter's point of view, this generally means that each pass of the ball past the batter is different. This is a benefit over the known prior art in that it gives randomly different "pitches" to the batter during a practice session. This variability in ball path makes it difficult for the batter to anticipate the next pitch and therefore accelerates his batting proficiency gains.

Another benefit that this device has over the others disclosed is its compact construction. Because the base unit is designed to sit low to the ground, supporting legs are not required. The base unit itself is quite compact with dimensions typical of a small suitcase and with a handle attached to one end, the pitching machine is easily moved about and easily set up.

Further, the entire invention may be broken down and packed into a 30"×12"×10" box for shipping. Packing the invention into a box of this size is made possible by removing all detachable parts from the platform assembly, removing the platform assembly itself from the base unit, and breaking the extension pole down at a joint in its mid-section.

(2) Objects of this Invention

An object of this invention is to provide a mechanical means for "throwing" or "pitching" a ball so that a batter can practice alone.

Another object of this invention is to provide a batting practice machine that is suitable for all ages and athletes of varying batting abilities.

An additional object of this invention is to provide a batting practice machine that randomizes the consecutively pitched balls.

Further objects are to achieve the above with devices that are sturdy, compact, durable, simple, safe, and reliable, yet inexpensive and easy to operate and maintain.

Other objects are to achieve the above with a method that is rapid and inexpensive and does not require highly skilled people to operate and maintain the device.

The specific nature of the invention, as well as other objects, uses, and advantages thereof, will clearly appear from the following description and from the accompanying drawings, the different views of which are not necessarily scale drawings.

Figure 1:
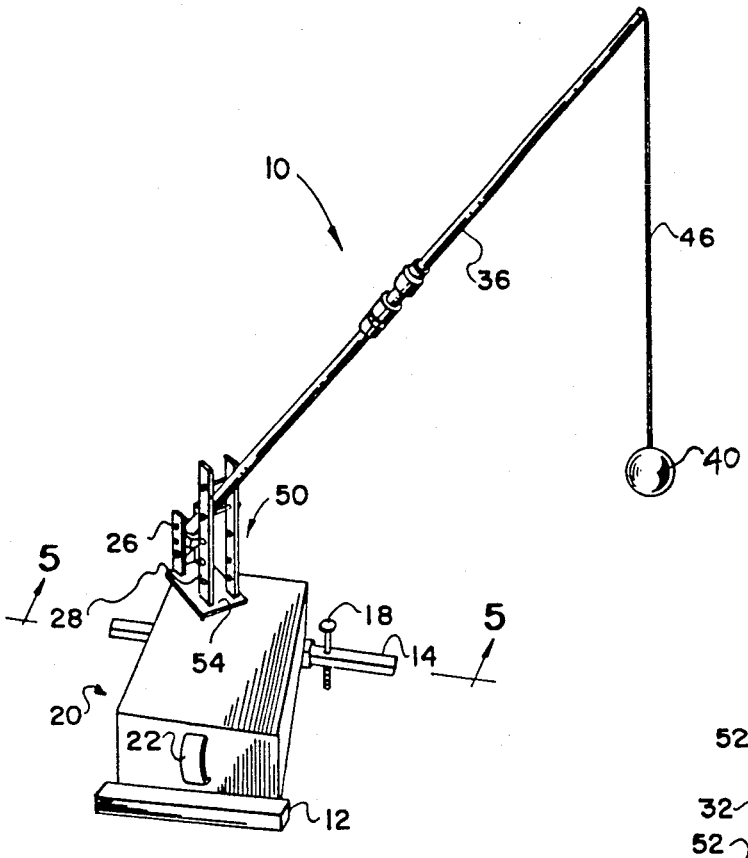
FIG. 1 is a perspective view of the pitching machine.
Figure 2:
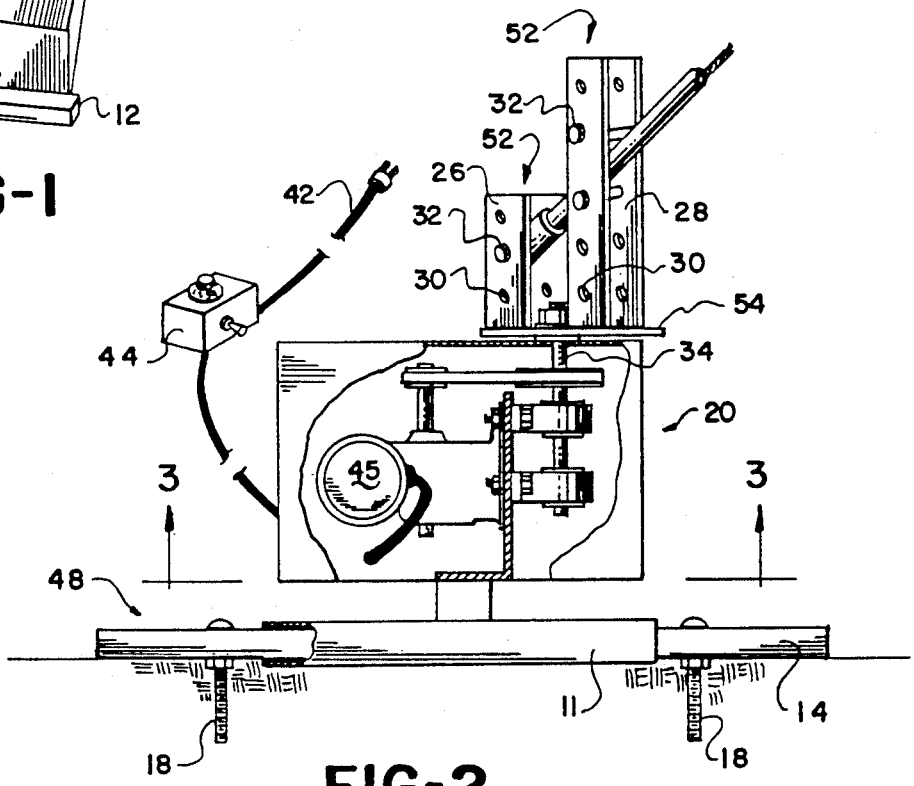
FIG. 2 is an elevational view of the front of the pitching machine with a portion of the housing cut away so that the motor and pulley system is exposed. The anchoring bolts are also shown extended into the ground.
Figure 3:
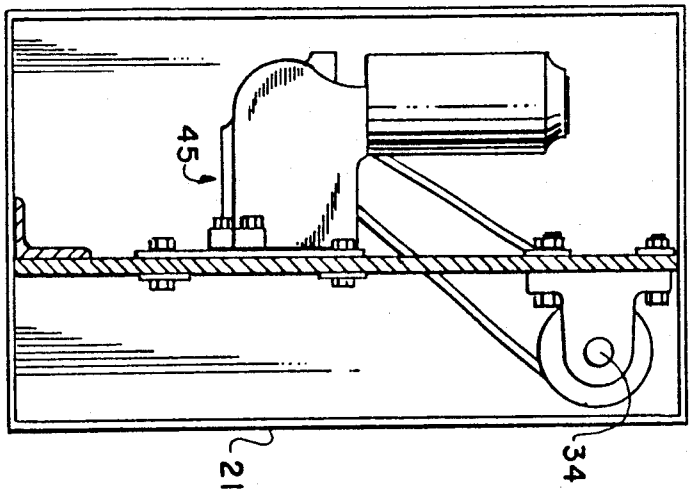
FIG. 3 is a bottom plan view of the base unit with a bottom portion of a center brace cut away showing the motor and pulley system.
Figure 4:
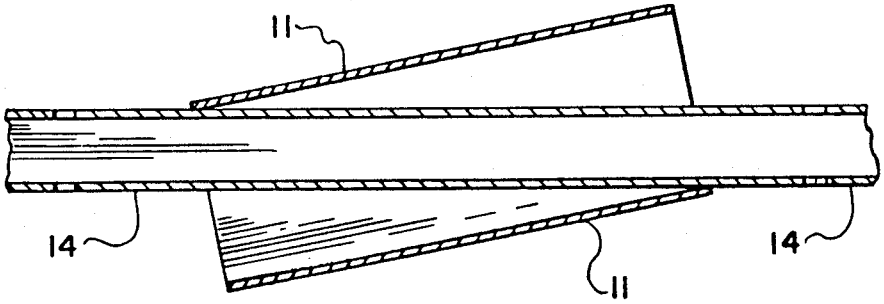
FIG. 4 is a longitudinal section of the stabilizing assembly with a long stabilizing arm installed into the stabilizing arm tube.
Figure 5:
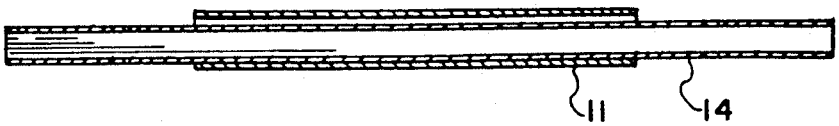
FIG. 5 is a longitudinal section of the stabilizing assembly in a rocked position with a short stabilizing arm installed into the stabilizing arm tube.

As an aid to correlating the terms of the claims to the exemplary drawings, the following catalog of elements and steps is provided:

| | |
|---|---|
| 10 | pitching machine |
| 11 | stabilizing arm tube |
| 12 | support tube |
| 14 | stabilizing arm |
| 18 | anchoring bolts |
| 20 | base unit |
| 21 | housing |
| 22 | handle |
| 26 | fixing strips |
| 28 | angling strips |
| 30 | adjustment holes |
| 32 | adjustment bolts |
| 34 | vertical shaft |
| 36 | jointed extension pole |
| 40 | ball |
| 42 | power cord |
| 44 | variable rheostat |
| 45 | variable speed electric motor |
| 46 | flexible cord |
| 48 | stabilizing assembly |
| 50 | platform assembly |
| 52 | upright strips or pintles |
| 54 | platform |

DESCRIPTION OF THE PREFERRED EMBODIMENTS

Referring to the drawings, a pitching machine 10 is seen. The machine includes a box shaped housing 21, a vertical shaft 34 that extends through a top side of the housing 21, and a platform assembly 50 which is fixed to a top end of the vertical shaft 34. A base unit 20 includes a variable speed electric motor 45, a belt and pulley system and the five sided housing 21.

The motor 45 has a drive shaft to which a round sheave is fixed. The vertical shaft 34 also has a round sheave which is linked to the sheave on the drive shaft by a flexible belt. Because of this linkage, the motor 45 rotates the vertical shaft 34.

The motor 45 is supplied electrical power through power cord 42 that has a plug at one end compatible with a standard grounded power outlet. The cord 42 is connected to the motor 45 at an end opposite the plug.

The speed of the motor 45 is controlled by variable rheostat 44 which is manually set to one of ten possible positions in this embodiment of the invention by an operator of the pitching machine 10. The rheostat 44 is located at a point along the cord 42 at a distance from both the plug and the pitching machine 10. Additionally, the motor 45 is reversible making it possible for either a right- or left-handed batter to use the machine 10.

The box shaped housing 21 has a lengthwise center axis that runs from one vertical end to the other and is normal to those vertical ends. The width dimension of the housing 21 is measured horizontally along these ends and is less than twelve inches. The length of the housing 21 is less than 25 inches and is measured horizontally along vertical sides that are parallel to the lengthwise center axis of the housing 21. The height of the housing 21 is measured vertically along either the ends or the sides of the housing 21 and is less than ten inches. The housing 21 also has a horizontal rectangular top side with dimensions equal to the length and width of the housing 21. The ends, sides, and top side are all planar and together, form the five sided housing that covers the motor 45 and belt drives. A bottom of the housing is adapted to rest on the ground upon a stabilizing assembly 48.

The vertical shaft 34 projects up through the top side of the housing 21 near a shaft end of the housing 21.

A handle 22 is attached to the end of the housing 21 opposite the shaft end of the housing 21. The handle 22 is easily grasped and the pitching machine 10 moved about from place to place.

The platform assembly 50 includes platform 54 which serves as a base for the platform assembly 50. The platform 54 is planar, rectangular in shape, and parallel to the top side of the housing 21. The platform 54 has a lengthwise centerline parallel to the platform's 54 longer side and a widthwise centerline that also bi-sects the side. The area of a top surface of the platform 54 is less than one-fourth the area of a top surface of the top side of the housing 21.

There is a hole in the center of the platform 54 where the two centerlines intersect sufficiently large to allow a threaded top end of the vertical shaft 34 to extend therethrough. In this embodiment, the platform 54 rests upon a flange that encircles the shaft and the platform 54 is secured to the shaft 34 by a washer adjacent to the top surface of the platform 54 and a nut tightened down against the washer by screwing the nut down onto the treads of the top end of the shaft 34. The tightened nut is prevented from loosening by a lock-washer that is positioned between the nut and the washer before the nut is installed upon the shaft 3 and tightened.

Upright strips 52, also refereed to as pintles, are welded to the top surface of the platform 54 thereby orienting the upright strips 52 so that the strips 52 stand on one end projecting upwardly above the platform 54 and away from the housing 21. Each strip 52 is constructed from metal ribbons having a width of about one and one-half inches and a thickness of about one-quarter of an inch.

There is a total of four upright strips 52 arranged into two pairs of parallel strips 52. One pair comprises fixing strips 26 and the other pair comprises angling strips 28. The angling strips 28 are the longer of the two pairs of upright strips 52 and have an approximate vertical length of one foot. The fixing strips 26 have a vertical length of about six inches. Each pair of strips 26 and 28 has about two inches of space between the two parallel strips 52 and the strips 52 are oriented so that each strip 52 is an equal horizontal distance from the lengthwise center axis of the platform 54. In other words, the pairs of strips 26 and 28 are centered about the lengthwise centerline. Additionally, the pairs of strips 26 and 28 are mounted upon the platform 54 so that there is a distance between the two pairs of about four inches.

There are adjustment holes 30 drilled along lengthwise centerlines of the strips 52 at approximately one inch intervals. Adjustment bolts 32 may be positioned in holes 30 that are at like heights above the platform 54 between the pairs of strips 26 or 28 thereby spanning the distance between each pair of strips 26 and 28. The bolts 32 are threaded at one end and have an enlarged head at the other end. A nut is screwed to the threaded end after the bolt 32 is inserted through both strips of the pair 26 or 28 thereby fixing the bolt 32 across the strips 26 or 28 until manually removed.

A jointed extension pole 36 is positioned between the fixing strips 26 and the angling strips 28. The pole 36 is flexible and comprises two sections of round plastic pipe that are joined by screwing an end of one of the sections into an end of the other section thereby forming the pole 36. When assembled, the extension pole 36 is at least five times the width of the housing 21.

A lower end of the pole 36 is fastened between the fixing strips 26 by an adjustment bolt 32 which is placed through a hole in the lower end of the pole 36 as well as adjustment holes 30 of the fixing strips 26. The pole 36 extends away from the fixing strips 26 through the angling strips 28 and beyond. The pole 36 is fixed between a pair of adjustment bolts 32 that are inserted along the angling strips 28 with enough space between the two bolts 32 to facilitate the diameter of the pole 36. The positioning of the pole 36 between the two bolts 32 is accomplished by first inserting a lower of the two bolts 32 between the strips 28. The pole 36 is then pivoted about the hole in the lower end of the pole 36 until it rests on the lower bolt 32. An upper bolt 32 is then fixed across the angling strips 28 thereby restricting the pole 36 between the upper and lower bolts 32. In the embodiment shown, this orientation requires that there be one empty hole 30 between the holes 30 on the angling strips 28 through which the bolts 32 are fixed.

The pair of adjustment bolts 32 in the angling strips 28 may be moved up and down in the adjustment holes 30 so that the incline at which the pole 36 is angled to horizontal is varied. By raising the bolts 32 in the angling strips 28 and keeping the bolt 32 in the fixing strips 26 at the same position, the angle at which the pole 36 is inclined is increased. Various angles can be accomplished by changing the orientation of the three bolts 32.

A flexible cord 46 is threaded through a hollow center of the pole 36 and extends from a distal end of the pole 36 opposite the lower end of the pole 36. The cord 46 is both flexible and resilient. The cord 46 can be constructed from different materials that have the above described qualities. This embodiment contemplates the cord 46 being made from a synthetic resin polymer, more specifically NYLON.

The cord 46 is fixed at the lower end of the pole 36 by placing a washer on the cord 46 and then tying a knot in one end of the cord 46 with said knot having sufficient size to prevent it from pulling through the washer. The end of the cord 46 without the knot is then telescoped into the pole 36 until the washer abuts the lower end of the pole 36. It is in this manner that the cord is fixed within the pole 36 and the length by which the cord 46 extends from the distal end of the pole 36 is established. It is also in this manner that the length of the cord 46 is changed and the flight path of the ball 40 is changed.

Ball 40 is tethered to the cord 46 at a distal end of the cord 46 away from the distal end of the pole 36.

When the pitching machine 10 is fully assembled and being operated, the electric motor 45 rotates the platform assembly 50 and the pole 36 thereby causing the flexible cord 46 to extend radially outward from the distal end of the pole 36 revolving the ball 40 about the base unit 20.

Beneath the base unit and housing are two square hollow tubes that are attached or fix to the bottom of the base unit 20 and oriented so that their lengthwise centerlines are transverse, and in the preferred embodiment normal to the lengthwise center axis of the housing 21. These tubes rest on the ground beneath the base unit 20. A sleeve created by the tubes is sufficiently large to allow stabilizing arm 14 to be telescoped into the sleeve.

The stabilizing assembly 48, including a stabilizing arm tube 11 and the stabilizing arm 14 is located below the shaft end of the base unit 20 nearest the platform assembly 50. The assembly 48 comprises at least two elements that form a lost motion connection. That is, one element 11 is rigidly fixed to the base unit and the other element 14 is anchored to the ground for rocking motion, one to the other. A support tube 12 is located at the opposite end of the base unit 20 from the stabilizing arm tube 11. The stabilizing arm tube 11 is longer than the support tube 12.

The stabilizing arm 14 has two pairs of holes through a top and bottom side of the arm 14 so that the pairs of holes are spaced along the lengthwise centerline of the arm 14 so that when the arm 14 is properly positioned within the tube 11, anchoring bolts 18 may be inserted down through each pair of holes from the top side so that the bolts 18 stab into the ground below securing the pitching machine 10 to the ground at points on each side of the tube 11.

Another anchor bolt 18 is inserted through support tube 12 located beneath the end of the base unit 20 opposite the stabilizing assembly 48.

As the machine 10 is operated by rotating the pole 36 at a selected speed the forces created by the revolving ball 40 induces a rocking motion to the pitching machine 10 about the lengthwise center axis of the housing 21 since the weight of the ball 40 is not balanced as it circles about the base unit 20. The rocking is controlled by the stabilizing assembly 48.

The arm 14 fits loosely within the stabilizing arm tube 11. The base unit 20 freely rocks across the space between the loosely fitting arm 14 and the tube 11. After the base unit 20 has rocked to an extent that the space between the arm 14 and tube 11 is closed, movement of the base unit 20 is stopped.

The degree of stability lent by the arm 14 is governed by the arm's 14 size. The larger the arm 14, the more stability it provides while the smaller the arm 14 the more rocking action is allowed. The desired degree of stability is accomplished by installing an arm 14 with a size that provides the desired amount of stability.

Because the pole 36 and flexible cord 46 which extends therefrom are fixed to the base unit 20, the rocking action of the base unit 20 is imparted to the pole 36 and in turn the cord 46 to which the ball 40 is tethered. The rocking of the base unit 20, together with the rotation of the platform assembly 50, produce a randomly differing flight path in the ball 40.

This flight path of the ball 40 may be further altered by changing the incline of the pole 36. By the incline of the pole 36, the distal end of the pole 36 is raised and the general height at which the ball 40 revolves is also raised.

The velocity at which the ball 40 revolves around the base unit 20 is governed by the speed of the electric motor 45 and the length of the cord 46. By increasing the speed of the motor 45 or the length of the cord 46, the velocity of the ball 40 is likewise increased.

By adjusting the speed of the ball 40 and exchanging stabilizing arm 14 exchanging or changing stabilizing arms 14 of different sizes, an operator can tailor the general characteristics of the flight pattern of the ball 40 (the actual path of the ball still remains random because of the rocking action) as the ball 40 passes a stationary batter so as to increase that batter's proficiency through his batting practice using the pitching machine 10.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A pitching machine having means for randomly varying a flight path of a ball thereby delivering constantly changing "pitches" to a batter, said pitching machine comprising:

a. a housing having a top and a bottom adapted to rest on the ground, b. a vertical shaft extending through said top, and c. an electric motor within for rotating said shaft, d. a platform positioned adjacent said top and attached to said shaft for rotation therewith, e. four upright strips attached to and extending upward from said platform for rotation therewith, f. an elongated pole having one of its ends attached to said upright strips, g. a cord having one of its ends attached to said one end of said pole, and extending from the other end of said pole, and h. a ball attached to the other end of said cord end of the cord.

2. The invention as defined in claim 1 wherein:

j. said cord being flexible and resilient.

3. The invention as defined in claim 1 wherein:

k. said pole extend upward from said upright strips, and l. means on said upright strips for adjusting the angle at which the pole extends upward.

4. The invention as defined in claim 9 wherein:

l. said pole extend upward from said upright strips, m. means on said upright strips for adjusting the angle at which the pole extends upward, n. means for adjusting the length of cord extending from said other end of said pole, o. the width of said housing being no more than four times the width of the motor, p. said platform is located a distance above the bottom of the housing that is less than the width of the housing, q. said pole has a length at least ten times the width of said housing so that the pitching machine wobbles as the pole is rotated, and r. an exchangeable stabilizer bar attached to the bottom said housing to control the amount the pitching machine wobbles.

5. The invention as defined in claim 1 further comprising:

k. means for adjusting the length of cord extending from said other end of the pole.

6. The invention as defined in claim 1 wherein:

k. the width of said housing being no more than four times the width of the motor.

7. The invention as defined in claim 7 wherein:

k. said platform is located a distance above a support surface that is less than the width of the housing.

8. The invention as defined in claim 1 wherein:

k. said pole has a length at least ten times the width of said housing so that the pitching machine wobbles as the pole is rotated.

9. The invention as defined in claim 8 further comprising:

l. an exchangeable stabilizer bar attached to the bottom of the housing to control the amount the pitching machine wobbles.

10. The invention as defined in claim 1 wherein:

k. said cord being flexible and resilient and made of NYLON.

* * * * *